US008101239B1

(12) United States Patent
Kean et al.

(10) Patent No.: US 8,101,239 B1
(45) Date of Patent: Jan. 24, 2012

(54) APPARATUS AND METHOD FOR PRODUCING AN INTERMEDIATE FIBROUS PRODUCT

(75) Inventors: Tod M. Kean, Chandler, AZ (US); James H. Kean, Boulder, CO (US)

(73) Assignee: Fibers Equipment LLC, Boulder, CO (US)

( * ) Notice: Subject to any disclaimer, the term of this patent is extended or adjusted under 35 U.S.C. 154(b) by 0 days.

(21) Appl. No.: 12/366,316

(22) Filed: Feb. 5, 2009

(51) Int. Cl.
*B05D 3/04* (2006.01)
*B05D 3/12* (2006.01)

(52) U.S. Cl. ..... 427/359; 427/365; 427/370; 427/372.2; 427/421.1; 427/427

(58) Field of Classification Search ..... 427/359, 427/337, 341, 342, 343, 372.2, 393.3, 421.1, 427/424, 427, 427.3, 532, 541–543
See application file for complete search history.

(56) References Cited

U.S. PATENT DOCUMENTS 3,944,688 A 3/1976 Inman
4,151,322 A 4/1979 Rosenthal et al.
4,194,032 A 3/1980 Harper, Jr. et al.
4,372,002 A 2/1983 Small
4,801,405 A 1/1989 Yamada et al.
4,908,910 A * 3/1990 Pinto et al. ..... 19/145.5
5,156,890 A 10/1992 Rock
5,389,309 A 2/1995 Lopez
5,642,601 A * 7/1997 Thompson et al. ..... 53/431
5,723,515 A 3/1998 Gottfried
5,912,196 A 6/1999 Radwanski et al.
6,042,639 A 3/2000 Valso et al.
6,423,251 B1 * 7/2002 Blount ..... 252/609
6,475,315 B1 * 11/2002 Kean et al. ..... 156/62.2
7,211,293 B2 5/2007 Piana et al.

* cited by examiner

*Primary Examiner* — Michael Cleveland
*Assistant Examiner* — Alexander Weddle
(74) *Attorney, Agent, or Firm* — Cahill Glazer PLC

(57) ABSTRACT

A continuous process for achieving specific levels of fire retardant properties for either natural fibers or synthetic fibers. Selected fibers are mixed and opened to be formed into a web that is continuously weighed and transported to a spray station to be sprayed by a selected fire retardant solution. The sprayed web is compressed between calendar rolls and transported to a dryer; the dried web is blended to form a selected fiber having a predetermined fire retardant characteristic to meet regulatory standards. An intermediate product results from the use of the process.

25 Claims, 2 Drawing Sheets

APPARATUS AND METHOD FOR PRODUCING AN INTERMEDIATE FIBROUS PRODUCT

The present invention relates to processes for achieving specific levels of fire resistant properties in natural fibers and synthetic fibers that are utilized in various industrial applications. The processes produced intermediate products that are incorporated in a large variety of end products, each of which requires a specific fire resistant property.

BACKGROUND OF THE INVENTION

The application of fire retardant materials to, and processes for treating, natural and man-made fibers are well known. Intermediate products comprising fibers thus treated are rendered suitable for automotive insulation, furniture cushioning, institutional and conventional bedding, appliance insulation, acoustical insulation and a variety of building materials.

Natural fibers that can be fire retardant treated for such uses include secondary cellulose (recycled newsprint), jute, flax, cotton, gin motes, wool, etc. Man-made synthetic fibers that can be effectively treated include polyester, polypropylene nylon and rayon.

There has been a growing need for improving the fire proofing of both natural and man-made fibers. Agencies such as the Federal Trade Commission and the Consumer Products Safety Commission have imposed numerous minimum standards on a host of consumer products. Stringent flammability regulations that effect manufacturing processes include bedding such as mattresses, the furniture business, automotive industry, children's garments, and various building materials such as insulation.

Various processes for imparting flame and fire resistant qualities have long been known and used, for example, in infant wear and other textile related industries. Also, some construction materials have long been regulated in such a manner that fire resistant technology must be employed. However, most of the work conducted on flame resistant fibers has been limited to two technologies: first, in the case of cotton, such as that used in bedding applications, finely ground boric acid powder is first applied to the unwoven fiber in a "willow" machine that distributes the powder throughout the cotton prior to it being carded or woven. This approach has been used for a number of years in the bedding industry because it is relatively inexpensive and does not require a great deal of processing equipment. This process has a significant weakness in that the fine powder does not penetrate or fuse itself to the individual fibers on a consistent basis and therefore does not thoroughly bond itself to the miniscule fibers. Hence, the utilization of powders, without being in solution, for most fire retardant requirements can no longer meet the current fire retardant standards imposed by regulatory agencies.

The second most common process for applying fire retardant chemicals to either natural fibers or man-made fibers is commonly known as the "immersion" process whereby the fibers are introduced to one or more vessels holding a formula of liquid fire retardant chemicals. While this technology, if properly employed, can provide a high level of fire retardancy, it has several shortcomings. One of the more negative aspects of this approach is the fact that much equipment and energy must be employed to remove the excess liquid (typically water) from the fibers. With the recent escalating cost of energy, whether electric or natural gas, the "immersion" process contributes to a very expensive approach to adding fire retardant chemicals to the chosen fibers. Compared to the present invention, the "immersion" technique requires much more equipment and therefore consequently leads to high maintenance costs, additional downtime, and higher capital requirements for machinery replacement costs.

SUMMARY OF THE INVENTION

The present invention provides a method for processing either natural or man-made fibers, in an open form, to produce an intermediate product that is suitable for achieving fire characteristic standards established by regulatory agencies but without requiring extensive equipment that is expensive and may have other negative implications.

The instant invention imparts flame resistant qualities of previously opened natural or man-made fibers. The method or process incorporates treating fibers that are provided to the present system from suitable supply sources and are "opened" and subsequently deposited in a web-like form onto a horizontal conveyor surface and may be between ½" to 6" thickness. The continuous web is supplied to a "weight belt" to ascertain the weight of the fibrous web that is being transported in the process. The web is then subjected to a continuous liquid spray of a fire retardant solution upon the upper surface of the web; the web is subsequently compressed by a set of calendar rolls to compress the web and facilitate the distribution of the fire retardant material throughout the matrix of fibers in the web. The web fibers are then transported through an oven, or a suitable heat source, to remove a desired amount of moisture from the web; the appropriately dried fibrous web material is then fed to a blender where the fibers are blended and the blended fibers are transported via an air duct (which may include heated air for predetermined additional drying) to a receiver for subsequent utilization. The fire retardant infused fibrous material forming an intermediate product may then either be baled for subsequent shipment to a further processing process or may be bulk loaded or specifically transported for further processing into a finished product.

The present system and method thus provides an economical and convenient manner for applying fire retardant materials to achieve a predetermined fire retardant value to an intermediate fibrous product that heretofore required expensive processing for the proper application of fire retardant to the fibrous material.

BRIEF DESCRIPTION OF THE DRAWINGS

The present invention may more readily be described by reference to the accompanying drawings in which.

DETAILED DESCRIPTION OF THE INVENTION

The present invention incorporates a method and apparatus that results in an intermediate product comprising a fibrous material having a fire retardant treatment assuring that the material will meet or exceed governmental or private standards of flammability including flame spread and smoke developed ratings. The method of the invention is much simplified and more efficient than previously developed processes for rendering both natural and man-made fibers fire resistant.

The natural fibers that can be fire retardant treated include secondary cellulose (recycled newsprint), jute, flax, cotton, gin motes, wool, etc. Synthetic fibers that can be fire retardant treated include polyester, polypropylene, nylon, rayon, etc. (many more). Chemical compounds in various ratios that can be used in the process include boric acid, sodium borate, ammonium bromide, organic phosphates, monoammonium phosphate, diammonium phosphate, calcium borate, ammonium sulfate, urea, melamine, and phosphoric acid. The chemical compounds set forth above are supplied in a formulation that allows the chosen chemical, or mixture thereof, to be mixed in water to form a solution. Some chemical formulations cannot reach a state of solution until the mixture is heated from 110° F. to a temperature of 200° F.

Figure 1:
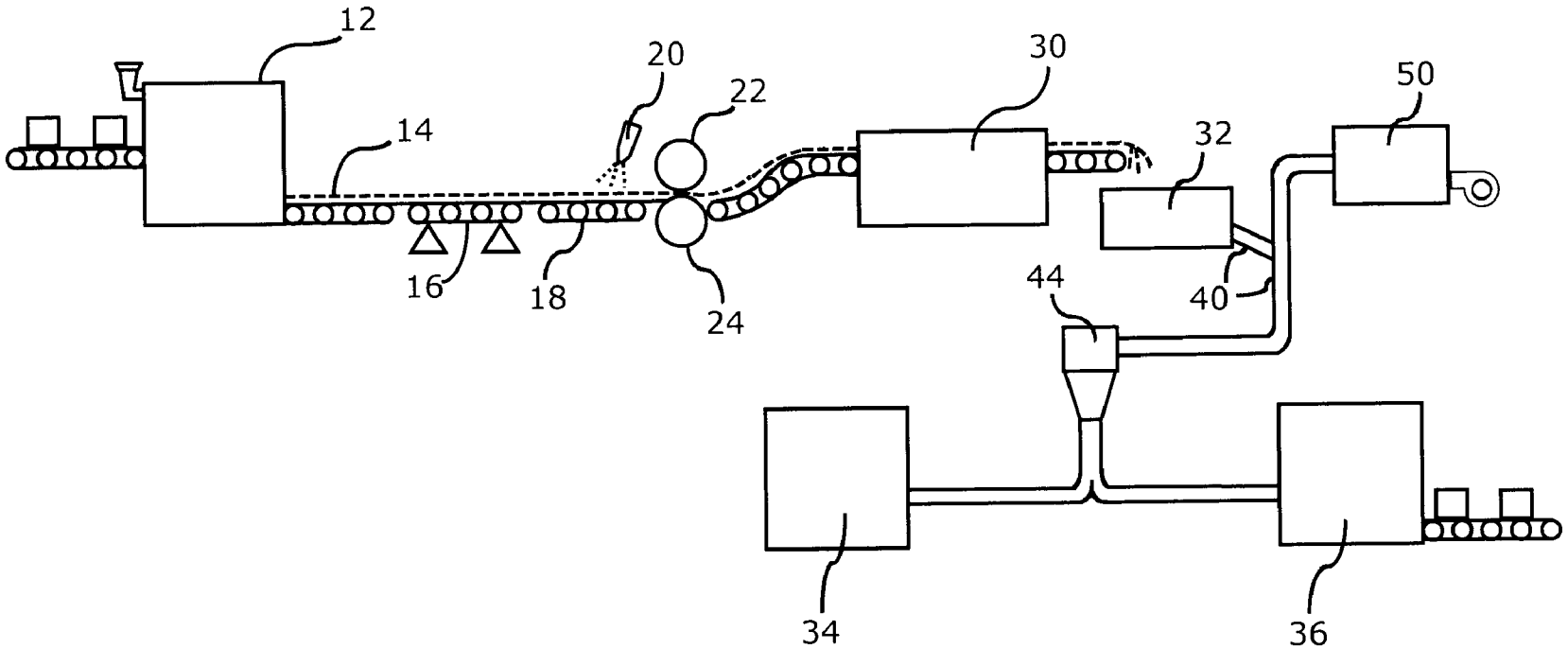
FIG. 1 is a schematic representation of apparatus arranged for receipt and manipulation of fiber material for applying fire retardant to the material to produce an intermediate product in accordance with the present invention.

Referring to FIG. 1, a fiber bale feeder 12 is provided, or in the alternative, a machine that can feed untreated bulk fiber in a consistent manner, forms a web 14 having width of approximately 3 ft. to 16 ft. The bale feeder is designed to open the bale with "pickers" or wire cylinders so as to provide a loose fibrous material with minimum knots or flags (loose fiber can be fed into the web-forming machine other than in bale form). The web 14 that is formed by the machine may be from ½" thick to 6" in thickness. It is believed that when using the process of the present invention, a web of approximately 3" is most desirable. The density, or pounds per cubic foot, should range from ½ pound per cubic foot to 5 pounds per cubic foot.

The web thus formed is transported to an apparatus or equipment item common in the textile industry, known as a weight-belt feeder 16 so that the fiber can be conveyed in a consistent manner and at a desired weight. The weight-belt machine continuously weighs the fiber passing over the scale in rapid succession so that the web speed can be regulated as to the desired weight. Once the web/sheet has exited the web forming machine and traveled over the weight belt, it is conveyed by an electric powered belt conveyor 18 traveling at a speed rate between 3 ft. per minute and 100 ft. per minute. The preferred rate of speed is approximately 50 ft. per minute. The conveyor 18 transports the web under a spray system 20 that emits a liquid fire retardant onto the web. The fire retardant solution may have a chemical mixture in a state of solution ranging from 10% to 75% in solid weight (percent of solids in solution). A preferred rate of solids is about 50%.

The spray system includes a number of nozzles (orifices) that are positioned in such a manner as to apply the fire retardant solution over the fibrous web in a thorough and consistent manner. The amount of fire retardant chemical applied to the fiber is predetermined and proportional to the weight of the fiber passing under the nozzles. The specified amount of chemical, or the chemical loading, is determined by a predetermined selected flame/smoke standard. A typical amount of chemical loading would be between 5% and 35% dry chemical loading (ratio with fiber weight). For most applications, the percent of solid chemical to fiber should be about 10% to 20%. A typical fire retardant formula for use in the subject invention would be: 60% monoammonium phosphate, 30% ammonium phosphate, and 10% boric acid powder. This formula would be mixed with an equal weight of $H_20$. Therefore, a 50% solution. In certain cases, depending upon the type of formula chosen, it may be necessary to heat the water from about 120° F. to 200° F. to assure solution. Regardless of the chemical formula selected, it is necessary to thoroughly mix the chemical (either liquid or powder); the mixing may occur using a batch method or a continuous method.

Included with the chosen chemical compound and water, a surfactant is added that has been found desirable to permit the mixture to completely wet the fiber as it passes under the spray nozzles. The percentage of surfactant in the fire retardant solution would be in a range of 0.001% to 0.005% by weight.

Suitable surfactants can be chosen by those skilled in the art from several sources such as Apexical Inc., Brenthe Pacific Inc. and the Huntsman Company. One of the desired surfactants for a natural fiber such as cotton is available from the Huntsman Company and is labeled ALBA Flow.

The amount of this fire retardant solution sprayed on the fiber may vary from about 10% to 50% of fiber weight, and preferably about 30%.

In accordance with the present process, it is important that the spray orifices apply the liquid formula with sufficient pressure so that the fire retardant chemical penetrates the web being conveyed beneath the spray bar. The pressure may vary between 25 psi and 150 psi, and preferably between 60 psi and 70 psi.

Other non-emersion techniques may be used to apply the liquid fire retardant material to the web surface. For example, a wetted roll surface having a liquid retaining coating could be used to impart the fire retardant to the web surface; similarly, a belt having a liquid transfer surface may be used to engage the web surface to transfer the fire retardant to the web surface. However, it is believed that the spray system of the preferred embodiment is the most effective manner of applying the fire retardant to the web surface.

Subsequent to the addition of fire retardant chemical to fibrous sheet, the conveyor transports the fiber between two or more calendar rolls 22, 24 to provide an additional means of assuring a complete application of fire retardant to the fibers to provide a homogeneous blend of fibers and fire retardant chemical. The diameter of these compression rolls may vary between 2" in diameter to 18" in diameter. The operating distance between the rolls will depend upon the original thickness of the web of fibers and the specific type of fiber being treated with fire retardant chemical. For a 3" web of natural fibers such as cotton being transported subsequent to the spray system, it has been found that about 1" opening between a set of compression rolls is desirable or about 33% of the original thickness of the web. The roll separation (distance from each roll surface to the other opposing roll surface) is preferably not less than about 20% of the web's total thickness although some fiber/retardant combinations may require further compression. Scraper knives (known as doctor knives) may be required as part of the apparatus to keep the rolls clean and free from fiber build-up. Scraper knives are well known to those skilled in the art and therefore are not shown.

After leaving the calendar rolls, the fibrous mat is conveyed to drying device 30, such as a through-air oven, that will drive off the desired amount of $H_20$. Other drying equipment such as electric radiant heat, double and triple pass gas dryers, or microwave dryers may be used for this step in the process. Care must be taken that the fibers are not overly heated (depending on the fiber type, they could be scorched or even melt) by excessive heat. Too much heat may also contribute to a condition whereby the fiber becomes brittle from overheating. The dryer's heat range is preferably between 150° F. and 375° F. A temperature of approximately 330° F. is found suitable for a web composed of cotton or other natural fibers. After the fiber stream passes through the selected dryer, a desirable amount of $H_20$ remaining in the fiber would range from 5% to 25% of the total intermediate product weight. In most cases, the desired amount of $H_20$ remaining in the product would be 10% to 15% after the dryer step in the process. Generally, in a through air oven, the heated air passes through the fibrous web. The specific temperature of the heated air is adjusted to provide the desired drying of the web.

In accordance with the present invention, after the fiber has been conveyed through the dryer, the material is fed to a blender 32 to be "mixed" or "blended" or "re-blended" so as to assure a consistent and uniform mix of tire retardant and fiber. The equipment used for this process step may include commonly known textile equipment such as "fiber openers" or fiber cleaning machinery. Such fiber cleaning machinery may typically include a series of cylindrical rolls each having a series of radially extending paddles or beater bars extending therefrom. These cylindrical rolls rotate with the bars or paddles extending into the fibers to separate the fibers as they are being transported past the rolls. The adjacent rolls have paddles or bars that are typically longitudinally offset from adjacent rolls to ensure that the fibrous material passing the rolls is contacted by the bars or paddles and separated thus converting the fibrous web into bulk fibrous material. The original intent of cleaners of this nature was to separate fibers such as cotton from debris or other foreign material; however, it has been found that the utilization of such machines in the present system provides an excellent "blending" of the fibers to insure that the mixture of fire retardant and fiber is uniform. After passing through the re-blending equipment, the fiber that has received the fire retardant treatment may proceed directly to an end-product manufacturing process or to baling equipment to be baled for shipment to another location for processing to a final product. In either case, it is preferable to convey the material by pneumatic duct work 40 to a cyclone receiver 44 which allows the product to drop by gravity to either a storage facility 34, high density baler 36, or directly into an end-product processing line.

An advantage of utilizing the pneumatic duct 40 for conveying the fiber is the fact that additional drying can be accomplished during the transport of the fiber from the blender 32. If deemed necessary, auxiliary drying may be added in the duct work by the use of a gas fired burner 50. A preferred burner is manufactured by either the Eclipse Company or Maxon Burner Company. If the process is being used to place the treated fiber in inventory for future use, or shipping the material to another user, it is necessary to bale the product. Such balers are available from Balemaster, Bolgraff, International Baler, and American Baler Company. One of the benefits of baling, other than for shipping and storage considerations, is the fact that the fire retardant treatment of the fiber is generally enhanced by a considerable degree. This phenomena is known as the "cure" effect. It may improve the fire resistant level as much as 15% over a non-baled fibrous material.

Figure 2:
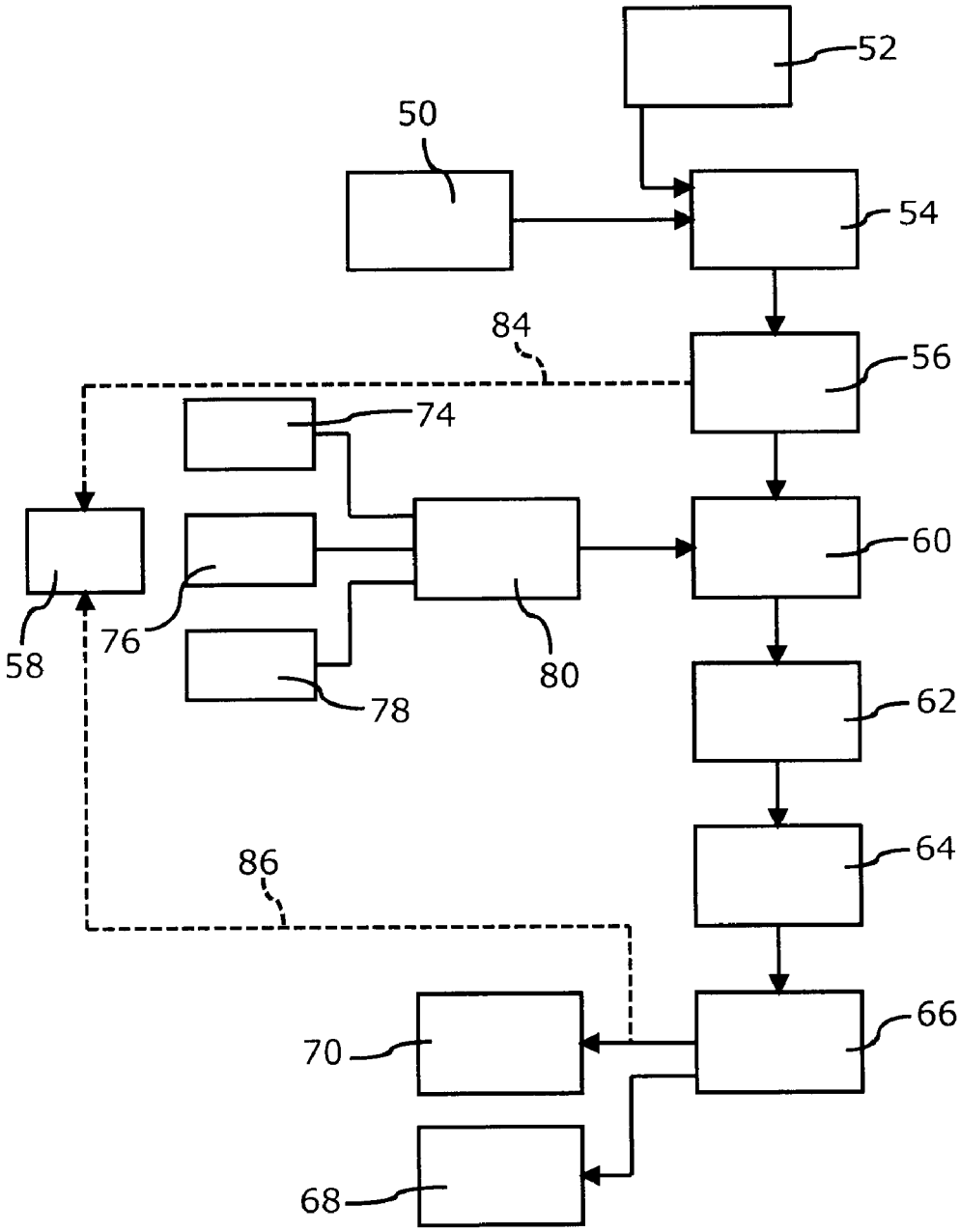
FIG. 2 is a flow diagram of the method of the present invention useful in the description of the process for treating fibers in the preparation of an intermediate product.

The method of the present invention may further be described with the help of FIG. 2. The present invention provides a process for processing either natural or man-made fibers or a combination thereof, that are in open form, and that are suitable for achieving fire characteristic standards established by regulatory agencies without the previously required use of extensive equipment and costly procedures. The present invention includes the admixing of about 0% to 100% by weight of natural fiber or blend of natural fibers with 5% to 100% of man-made fibers in a homogenous mixture of fibers. These fibers may be supplied from inventory in the form of bales from a bale feeder 50 or supplied as loose fibers 52; in either case, the fibers are mixed and opened 54. The mixed and open fibers are deposited in a web-like form onto a horizontal planar surface such as a conveyor to form a web from approximately ½" in thickness to 6" in thickness. The web is continuously weighed by a conventional weigh belt feeder 56 and the information from the weigh belt is supplied to a conventional data processor 58 to be included with other data to determine the appropriate mixture of elements in a fire retardant solution for application to the web. The appropriate mixture proportions of fire retardant chemicals, water, and an appropriate surfactant is determined and supplied to a spray bar system that sprays the liquid fire retardant mixture on the web-like structure being conveyed past the spray system 60. The web, being conveyed on a conveyor belt, is between 3' and 15' in width and travels at a speed of 3' per minute to 100' per minute. As the fibers are conveyed beneath the spray bar system the appropriate amount of liquid fire retardant chemical mixture is sprayed on the web with a pressure between 20 psi and 150 psi.

By applying the fire retardant mixture with a spray system in this manner, the total water content deposited in the fiber may vary from 10% to 50% with respect to the weight of the fiber prior to the spray bar application: adding the surfactant to the liquid fire retardant solution is proportioned to an amount between 0.001% and 0.005% of the dry weight of the fire retardant chemical in the solution.

The sprayed web of fibrous material is conveyed through a set of calendar rolls 62 to compress the web and the fire retardant chemicals. The wetted web is then passed through an oven 64 to remove a desired amount of water from the web. Upon leaving the drying source, the fibers are delivered to a blender 66 to thoroughly mix and blend the fibers to form a homogenous mass of fibers that have been subjected to contact with fire retardant material. The blended fiber mass is then conveyed, such as through a pneumatic duct that may include heated transport air to facilitate additional drying of the fiber to a temporary bulk storage 68 or to a baling press 70 where it can be baled and placed in inventory for shipment for future use.

The determination of the appropriate mixture of fire retardant ingredients may be determined empirically by testing fibers exiting the blender and adjusting the parameters of the fire retardant mixture as well as the amount of fire retardant being applied to the fiber web as it passes the spray bar. This determination can be made on a batch basis, continuous monitoring basis, or a combination of these. For example, FIG. 2 shows a representation of a chosen fire retardant 74, water 76, and a selected surfactant 78 that are mixed and temporarily stored 80 to subsequently be applied to the fiber web. The rate of application is controlled by responding to data concerning the fiber web being processed such as weight data 84 and feedback data 86 taken from the fiber as it exits the blender 66 and before it is sent to the baler 70 or bulk storage 68. This feedback or test data may be selected from a desired or required fire retardant test specification that measures the efficacy of the fire retardant that has been applied to the fiber.

Test procedures commonly used for determining the effectiveness of the fire retardant treatment of textile fibers include the ASTM Steiner E-84 Tunnel Test, the ASTM C-739 Radiant Panel Test, ASTM 1633, ASTM 1632, and the limiting oxygen index test (ASTM D-2863). The latter mentioned procedure is commonly known as the LOI test and is utilized to evaluate the flame performance characteristics of textile materials employed in the U.S. bedding industry and in the manufacturing of natural fiber residential or commercial insulation.

Thus, the process includes receiving loose fibrous material and forming a web of material, transporting the web while weighing the web and subjecting the web to a spray of fire retardant material on the surface thereof. The sprayed or wetted web is then transported through calendar or compressing rolls to compress the web and the web is thereafter subjected to a drying procedure such as a forced air oven. The dried web is then blended and is then ready for transport to temporary bulk storage or to baling whereby the treated fiber may then be delivered to a desired location for further process into a finished product. The intermediate product supplied by the present invention is thus comprised of a selected fibrous material that has been subjected to the application of a fire retardant material in a unique manner to insure that the resulting intermediate product is a fiber product conforming to the requirements of fire retardant specifications and is therefore ready to be utilized in a chosen final product.

Example

A chosen textile fiber was treated with fire retardant using the method of the present invention; the method was structured to achieve a minimum industry index level using the LOI test procedure. The minimum LOI test index required for natural fiber insulation batts used in residential housing is 24. The natural fiber chosen for this example was "reprocessed" post-industrial blue denim fiber obtained from a textile denim sewing operation. The term "reprocessed" is used here in its usual meaning in the art, specifically, that the fibers be in their untangled configuration. Once the post-industrial fibers are opened in as near as possible to their original cotton condition by a textile related company that specializes in such work, the fibers are compressed in approximately 500 to 600 pound bales. The bales are then forwarded to processing plants that use the fibers for various finished products. Using the method of the present invention, these and various other types of either natural or synthetic fibers may be treated with fire retardant chemicals.

In accordance with the present method, the denim fibers to be treated with fire retardant chemicals were first introduced into a bale opener and fiber feeding machine that supplies a continuous and consistent web of fibers onto a horizontal conveyor at a predetermined rate. In this example, the specific continuous feed weight for the method was thirty-five pounds of fiber per minute. After the fiber in bale form was placed on the bale feeder conveyor, it was fluffed by two picking cylinders that open the fibers into a consistent form. Following this operation, the fibers were deposited in web form on a weigh-belt conveyor that regulated the flow of fibers by weight through subsequent method steps. For this example, a combination of 60" wide bale opener, web former, and weigh-belt as manufactured by Dell'orco and Villani was used (Model CAP/140/2). The web of fibers conveyed by the weigh-belt was about 3" in thickness and had a density of approximately 1.5 pounds per cubic foot. After being transported by the weigh-belt, the web of fibers was deposited on a flat rubber belt conveyor that fed the fiber into a through-air gas fired dryer. The conveyor used in this example was 27' in length and 55" in width.

Conveyed at a belt speed of about twenty feet per minute, the web of selected fibers was conveyed beneath a spray bar fabricated with a series of nozzles that emit a solution of water and fire retardant chemicals on the web. This solution also contained a surfactant which is desirable to permit the fire retardant mixture to penetrate the fibrous web to the maximum extent. In this example, the surfactant chosen was manufactured by Huntsman Company labeled as ALBA Flow. The add-on weight of chemical to the fiber weight was 17% or 6 pounds of dry chemical per minute. To achieve an appropriate level of penetration of the fire retardant solution into the web fibers, it was preferable to use a chemical pump that delivered approximately 60 psi of solution from the nozzles attached to the spray bar. In this instance, the fire retardant solution was sprayed from six nozzles located approximately 10" from each other and 15" vertically from the web surface. It is preferable that the spray apply an even coverage over the entire web surface as it passes beneath the liquid distribution system. The nozzles employed were secured from Spray Systems Inc. and the pump was a Verderflex hose pump that is suitable for pumping acids and other corrosive materials (Model VF 125/2hp). A two-way solenoid valve allows the liquid fire retardant chemical to recirculate back to working vessels for temporary storage when the fiber conveyor malfunctions or comes to a stop. Stainless steel pipes were used that deliver the chemical to the spray nozzles from a batch tank and were highly insulated in order to maintain a desired temperature necessary for keeping the chemical compounds in solution in the liquid chemical.

A wide variety of chemicals may be used to achieve acceptable flame resistant properties in either synthetic or natural fibers; however, for the present example, it was deemed preferable to select a formula that was specific for cotton treatment and was also economical for the end-use insulation material. In order to satisfy these criteria, the formula included ammonium sulfate, boric acid, and urea. All three compounds were acquired and utilized in powder or granular form. The ratios for the specific chemical compounds may vary from 25% to 70% for ammonium sulfate, 10% to 30% for boric acid, and 10% to 30% for urea. The Huntsman surfactant was added to the chosen formula at a 0.001% to 0.005% level to the total weight of the fire retardant solution. An accurate method of batching the granular chemicals with water was accomplished with a commonly used weigh-cell batching system that handles typical bulk-bag containers. Such systems can be purchased from Accurate Inc. or Acrison Systems Company. In order to gain complete solubility of the chemicals and water, each batch was initiated with preheated water at 180° F. as the chemical was added from the weigh-feeders, a lighting-type mixer was employed to achieve complete solution. Subsequent to mixing a complete batch of 400 pounds of chemical and water, the contents of the vessel were transferred to a ready vessel with the fire retardant solution ultimately delivered to the spray bar apparatus. Once the ready vessel received the mix, the batching system repeated the cycle.

After exiting the liquid coating application by the spray apparatus, the web comprising the fibers and fire retardant chemicals was passed through a set of calendar rolls positioned approximately 2' beyond the spray system in the direction of web travel. The stainless steel rolls were positioned at right angles to the conveyor transporting direction and were sufficiently close to each other so that the fiber web, including the fire retardant chemical solution, was compressed by approximately 80% of the web thickness prior to entering the rolls. This compression of the wetted web assures a high percentage of individual fiber coating by the selected fire retardant solution. To assure that the web fibers continue to move at a consistent rate of speed on the conveyor, the calendar rolls were driven at the precise same surface speed as the conveyor speed. Each roll was maintained in a relatively clean state through the use of doctor blades, or plastic scrapers, so that an even rate of compression was achieved across the width of the web. Such calendar rolls may be purchased from fabricators that specialize in such equipment or they can be fabricated from stainless steel tube stock. The calendar rolls employed in the present example were shop-made and were driven with two horsepower electric motors connected to a variable speed transmission.

After passing through the calendar rolls, the fibrous web was conveyed to a through-air gas fired oven so that excess water could be removed from the fiber, leaving the fire retardant chemical remaining on the individual cotton fibers. The stainless steel perforated belt used in the example exhibits about 30% open space in the belt to allow heated air to pass through the fiber without affecting the integrity of the web. It is essential that the web, as it is conveyed through the oven, maintain a consistent form so that the air flow is even throughout the drying process. In the present example, the oven temperature was approximately 350° F. and the airflow through the web was approximately 15,000 cubic feet per minute. The volume of air in terms of cubic feet per minute, and the temperature of the air, will depend upon the fiber type being treated and the amount of moisture in the fiber. Ambient conditions will also affect these determinations. The specific temperature of the heated air will be adjusted as recognized by those skilled in the art, in accordance with the specific fiber being treated, the thickness of the web, and the amount of liquid fire retardant that has been applied. In general, temperature of approximately 350° F. to 375° F. are used with residence times of about 25 seconds to 60 seconds in the dryer. In this example, a Belt-o-matic Model 430BX dryer, manufactured by the M. N. W. Industries was employed for meeting the drying requirements. This particular unit is 40' in length and utilizes a Maxon Ovenpak burner with a 4 million BTU capacity. The air movement through the oven was accomplished with a 30 horsepower New York fan that can deliver up to 20,000 cubic feet per minute of air.

After the through-air oven removed the excess moisture, the fiber along with the fire retardant chemical was delivered by the oven conveyor to two textile fiber cleaners mounted in series. As described above, the purpose of these cleaners, or blenders, is to blend the fibers and chemicals into a homogenous mass. Each of the two units contains a plurality of rotating shafts (six shafts in each unit) each having a series of beater bars or steel paddles extending radially from the rotating shafts that transport the fibrous material forward and simultaneously blend the fiber. While there are a number of machinery brands that are known as cotton fiber step cleaners, the brand chosen as the appropriate blender for this example was manufactured by Lummus Corporation and is marketed as the Hi-Cel Cleaner. A similar cotton cleaner that can be utilized in the present method for blending the fibers is fabricated by Continental Machinery Company.

The highly blended fibers exit the second fiber cleaner into an 18" galvanized air duct that can convey the finished intermediate product to a haling operation or to a downstream manufacturing process. Under some circumstances, it may be desirable to include an air heater system to add heat to the air utilized in the pneumatic duct to provide additional drying to ensure that the finished intermediate product exhibits an appropriate moisture level.

As the cotton fiber in the present example was processed as described above, samples of the fiber were taken as the blended fibers exited the second fiber cleaner and tested with the prescribed LOI test procedure to ascertain the LOI index exhibited by the intermediate product. Four tests were conducted in the present example, the tests conducted at thirty minute intervals during the example run. As indicated above, the minimum LOI test index required for the material being processed in this example, that is natural fiber insulation Batts for use in residential housing, is 24. It may be noted by reference to the following test results that the LOI index successfully complied with the requirements for natural fiber insulation batts used in residential housing.

| Limiting Oxygen Index Test - ASTM D2863 | | |
|---|---|---|
| Sample Fiber @ time | T | Index = 24 |
| | T + 0:30 | Index = 25 |
| | T + 1:00 | Index = 25 |
| | T + 1:30 | Index = 25 |

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A method for producing an intermediate product comprising the following steps in order:

(a) receiving loose fibrous material to be treated with fire retardant;

(b) forming a web from said loose fibrous material;

(c) spraying a liquid fire retardant solution on a surface of said web;

(d) passing said web between opposing calender rolls to compress the web;

(e) drying the web; and (f) blending the fibrous material in the web to form bulk fibrous material having uniform mixture of fire retardant and fiber therein.

2. The method of claim 1 wherein the loose fibrous material is a natural fiber.

3. The method of claim 1 wherein said loose fibrous material is cotton.

4. The method of claim 1 wherein said web is formed having a density of 0.5 to 5.0 pounds per cubic foot.

5. The method of claim 1 wherein said web is formed having a thickness from ½" to about 6".

6. The method of claim 1 wherein the fire retardant solution comprises water, fire retardant chemicals, and a surfactant.

7. The method of claim 6 wherein said fire retardant solution contains 10% to 75% solids by weight.

8. The method of claim 6 wherein said fire retardant solution contains 50% solids.

9. The method of claim 1 wherein said liquid fire retardant is sprayed on said web at a pressure of 25 psi to 150 psi.

10. The method of claim 1 wherein said liquid fire retardant solution is sprayed on said web at a pressure of 60 psi to 70 psi.

11. The method of claim 1 wherein said spraying a liquid fire retardant solution on the web provides a chemical loading of said web of 5% to 35% solid fire retardant chemical to fiber by weight.

12. The method of claim 1 wherein said spraying a liquid fire retardant solution on the web provides a chemical loading of said web of 10% to 20% solid fire retardant chemical to fiber by weight.

13. The method of claim 1 wherein said fire retardant solution comprises equal parts of fire retardant and water and 0.001% to 0.005% surfactant by weight.

14. The method of claim 1 wherein the spraying of a liquid fire retardant solution on the web continues until the fire retardant solution is about 10% to about 50% of the weight of the fiber.

15. The method of claim 1 wherein the spraying of a liquid fire retardant solution on the web continues until the fire retardant solution is about 30% of the weight of the fiber.

16. The method of claim 1 wherein the liquid fire retardant solution includes a fire retardant chemical comprising by weight 25% to 70% ammonium sulfate, 10% to 30% boric acid, and 10% to 30% urea.

17. The method of claim 1 wherein said web is compressed to about ⅓ of its uncompressed thickness.

18. The method of claim 1 wherein said web is compressed to not less than about 20% of its uncompressed thickness.

19. The method of claim 1 wherein said web is dried to a water content of 5% to 25% of the total weight of the web.

20. The method of claim 1 wherein said web is dried to a water content of 10% to 15% of the total weight of the web.

21. The method of claim 1 wherein said web is dried by passing heated air through the web at a temperature from about 150° F. to about 375° F.

22. The method of claim 1 wherein said web is dried by passing heated air through the web at a temperature of about 330° F.

23. A method for producing an intermediate product comprising the following steps in order:

(a) receiving loose fibrous material to be treated with fire retardant;

(b) forming a web from said loose fibrous material;

(c) weighing said web;

(d) spraying a liquid fire retardant on a surface of said web;

(e) passing said web between opposing calender rolls to compress the web;

(f) drying the web; and (g) blending the fibrous material in the web to form bulk fibrous material having uniform mixture of fire retardant and fiber therein.

24. The method of claim 23 wherein said weighing of the web is continuous.

25. The method of claim 23 wherein said web is transported, after being formed, on a weigh belt to provide a continuous indication of weight.

* * * * *